United States Patent [19]

Rottleb

[11] Patent Number: 4,659,032

[45] Date of Patent: Apr. 21, 1987

[54] SPOOLS FOR YARNS, THREADS OR THE LIKE

[75] Inventor: Dieter Rottleb, Gutach, Fed. Rep. of Germany

[73] Assignee: Guterman & Co. A.G., Zurich, Switzerland

[21] Appl. No.: 768,153

[22] Filed: Aug. 22, 1985

[30] Foreign Application Priority Data

Aug. 25, 1984 [DE] Fed. Rep. of Germany ..... 3431335

[51] Int. Cl.[4] ..... B65H 75/14; B65H 75/28

[52] U.S. Cl. ..... 242/118.4; 242/125.1

[58] Field of Search ..... 242/118, 118.4, 125, 242/125.1, 125.2

[56] References Cited

U.S. PATENT DOCUMENTS

| | | | |
|---|---|---|---|
| 2,565,673 | 8/1951 | Yven et al. | 242/125.1 X |
| 3,357,169 | 12/1967 | Bigiel | 242/118.4 X |
| 3,658,275 | 4/1972 | Lahmann | 242/118.4 |
| 4,027,831 | 6/1977 | Rottleb | 242/125.2 X |
| 4,165,055 | 8/1979 | Dee | 242/125.2 |
| 4,317,548 | 3/1982 | Rottleb | 242/125.2 |

FOREIGN PATENT DOCUMENTS

| | | |
|---|---|---|
| 0008490 | 3/1980 | European Pat. Off. . |
| 0073605 | 3/1983 | European Pat. Off. . |
| 2702802 | 7/1978 | Fed. Rep. of Germany . |
| 2656326 | 7/1979 | Fed. Rep. of Germany . |
| 1247970 | 9/1971 | United Kingdom . |

*Primary Examiner*—Donald Watkins

*Attorney, Agent, or Firm*—Cushman, Darby & Cushman

[57] ABSTRACT

A spool (1) comprises a sleeve (4, 4'), flanged members (2, 3) and a resilient dish-shaped member (6) positioned between a thread-winding retaining flange (5, 5') and one of the flanged end members (2). Member (6) is in the form of a conical spoked wheel (FIG. 11). Flange (5, 5') has peripheral teeth (20) for guiding thread onto and a chamfered rim (25) which cooperates with a chamfered rim on member (6). The thread cascades (FIG. 18) from one rim (25) onto the other (27) and is thereby positively guided between member (6) and flange (5). Member (6) applies a positive but gentle clamping pressure to thread trapped at any point about its periphery. Sleeve (4) is made of identical halves which are welded together within an outer sleeve of variable diameter. The construction and interchangeability of the components facilitates production of different high quality spools, e.g. to accommodate different lengths of threads.

17 Claims, 18 Drawing Figures

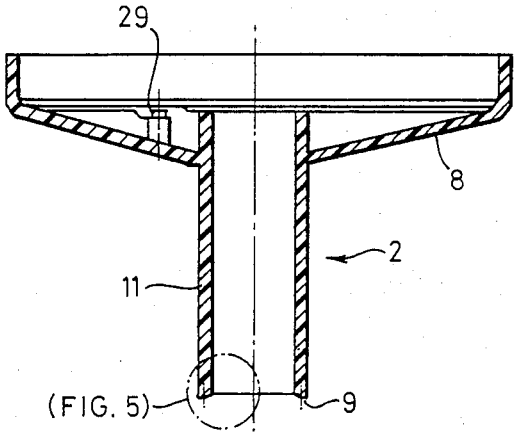
FIG 2
FIG 4
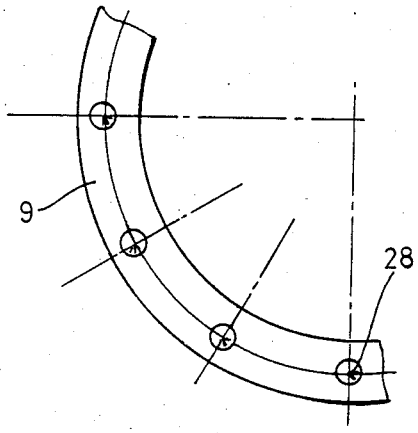
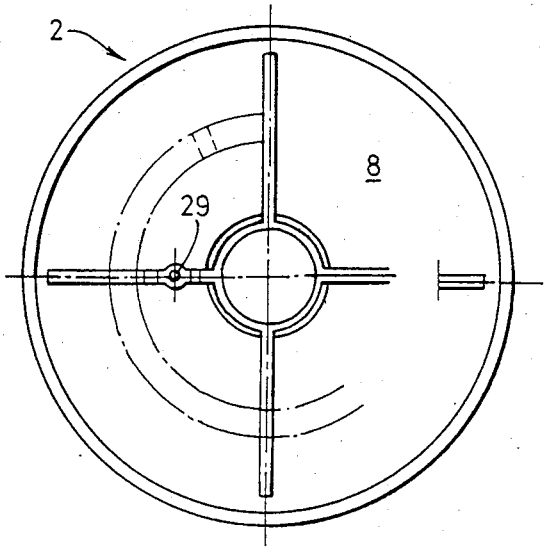
FIG 3
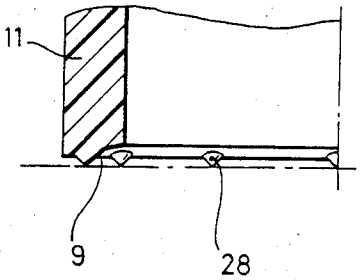
FIG 5

SPOOLS FOR YARNS, THREADS OR THE LIKE

This invention relates to a spool for yarn, thread or the like, the spool comprising a sleeve, flanged members at respective ends of the sleeve, and a circular member positioned adjacent one of the flanged members to provide means for trapping a loose end of yarn, thread or the like wound on the sleeve.

Spools of the latter type are known from EP-A-0073605. However, the spool disclosed in EP-A-0073605 includes circular member in the form of a substantially rigid ring. The ring is rigid to prevent deformation when thread is wound onto the sleeve at high speed during manufacture. This winding process causes strong lateral forces to be applied against the flange at one end of the sleeve and against the ring at the other end of the sleeve. If the ring were not rigid, it would be deformed by the strong forces and such deformation would interfere with the action of the thread trapping means.

In the spool of EP-A-0073605, the ring is positioned against a flange having a conical face so that the flange, together with the ring defines a wedge-shaped peripheral recess for trapping thread. To improve the grip on the thread, the inclined face of the flange includes a series of resilient tongues which are alternately spaced by small protuberances.

In the case of a wedge-shaped recess, the thread trapping action depends on pulling thread of a suitable thickness into the wedge-shaped recess. Such a "wedging-action" is common to many different types of conventional spools. However, this type of "wedging-action" has several disadvantages. For example, whilst a wedge-shaped recess can accommodate thread having a thickness (i.e. cross-section) which varies over a limited range, the wedge-shape is designed, in practice, to trap thread of a certain predetermined minimum thickness. Another disadvantage is that thread can become damaged if it is pulled too tightly into the wedge-shaped recess. However, if thread is drawn only lightly into a wedge-shaped recess, it can easily fall out. This problem is due to the way in which thread is trapped over only a limited extent of the wedge-shaped recess, e.g. between the ring and the inclined face of the flange in the spool of EP-A-0073605 (hence the need for the resilient tongues to improve the grip on the thread).

Therefore, whilst the "wedging-action" may enable the thread trapping means to be of simple construction, a positive grip on the thread may not always be achieved. Previous attempts to overcome this problem have led to spools of more complicated construction which are hence more expensive to manufacture. For example, a complex moulding would need to be tooled in order to produce certain types of spools and this type of moulding would need to be produced in a variety of different shapes and sizes in order to mass-produce spools for different lengths, thicknesses and types of thread. Clearly, this increases the cost of manufacture.

Despite the cost, it is essential to provide a positive thread trapping action to avoid problems which can arise when winding thread onto spools at high speeds during manufacture. With high speed winding, it is vital to ensure that the loose end of the thread is effectively trapped so as to avoid any unravelling. If the thread breaks, or if it is not properly secured and becomes free of the thread trapping means, the high speed winding process is interrupted to rectify the fault and the interruption may be prolonged by the need to remove tangled thread. Besides these manufacturing problems, it is also essential to ensure that the loose end of thread does not become detached from a spool during subsequent handling, e.g. when the spools are packaged and commercially distributed. Moreover, when the spool is used by a sewing machinist, it is important to ensure that thread is not trapped too loosely, so that it falls out, or too tightly, so that it either breaks when removed, or interferes in any way with the process of sewing when thread is drawn off the spool.

The above-mentioned problems are aggravated by the need to accommodate threads and yarns of various thicknesses and types. For example, not only does the thickness of thread vary, but thread is made of different materials (e.g. synthetic or natural) and it may be treated or coated in some way which affects its frictional properties. Hence, thread which is too thin, too thick, or which has been treated in some way, may not be effectively trapped even though the thread trapping means has been designed to reduce the above-mentioned problems.

The object of the invention is to provide a spool with thread trapping means of a relatively simple construction but having a more positive thread trapping action than the known spools.

This object is achieved, according to the invention, by providing thread trapping means wherein a resilient, circular dish-shaped member is positioned between a thread winding retaining flange and a flanged member at one end of the spool.

Preferably the dish-shape is formed by an inner axial portion and an outer peripheral portion which are located in different planes by means of an intermediate portion or portions which join the inner and outer portions.

The dish-shaped resilient member, due to its flexibility of construction, provides a gentle, but positive thread trapping action compared with the less satisfactory "wedging-action" of some conventional spools. It can also accommodate thread of a wider range of thicknesses. Moreover, as it has a relatively simple construction, especially when produced as a separate component (see below), the problems of design and manufacture are alleviated. Preferably, the dish-shaped resilient member is a cup-spring in the form of a spoked wheel wherein the outer peripheral portion corresponds with the wheel rim, the inner axial portion corresponds with the spokes.

The dish-shaped resilient member, particularly in the form of a spoked wheel, has the following advantages:

(1) Thread can be trapped gently, but positively between the wheel rim and the face of the adjacent flanged end member at any point along the circularly extending rim.

(2) A positive thread trapping action is assured with thread having a greater range of different thicknesses and the thread trapping action is substantially uniform over such a range.

(3) The rim and the spokes flex in such a way as to provide a kind of "latching" action, instead of e.g. a "wedging-action" used in conventional spools, and this helps to secure the thread more positively.

(4) There is less risk of damaging thread compared with conventional spools which employ the "wedging action", especially where thicker thread is to be trapped.

(5) Thread may be trapped at two independent points on the rim, e.g. when thread is drawn across a chord which intersects the circular rim at different circumferential points.

(6) There is less need to design the thread trapping means to suit thread of different thicknesses and hence spools which embody the invention are more versatile.

Preferably, the dish-shaped resilient member is frusto-conical in shape. In this case, the confronting face of the adjacent flanged end member of the spool and the thread winding retaining flange are both correspondingly and conically shaped, the thread winding retaining flange being recessed to accommodate flexure of the dish-shaped member. A conical flange is preferred, since this offers greater resistance to deformation due to the lateral forces which are exerted by the thread when it is tightly wound on the sleeve.

Preferably, the peripheries of the thread-winding retaining flange and of the dish-shaped resilient member have chamfered rims which assist in leading the thread between the resilient member (wheel rim) and the face of the flanged end member. These rims preferably project in an axial direction away from the sleeve with the rim of the resilient member projecting further than the rim of the thread-winding retaining flange. The chamfered rims thereby cooperate so that thread cascades from the retaining flange onto the outer peripheral portion of the resilient member whereby it is guided between the resilient member and the flanged end member. An advantage of this construction is that guidance of the thread into the correct thread trapping position is well-defined and hence there is little or no chance of thread being misguided into a clearance gap between the thread winding retaining flange and the resilient member. This problem is encountered with a spool of the type described in EP-A-008490.

The spool described in EP-A-008490 is made as a one-piece moulding of plastics material, a flanged end member being connected to a body by frangible bridging means. After taking the spool from the mould, there is a relatively wide gap between the flanged end member and a flexible flange which normally cooperates with the flanged end member to provide the thread trapping means. However, the bridging means is broken, by exerting pressure on the flanged end member, to close the gap between the end member and the flexible flange. A thread winding retaining flange is provided adjacent the flexible flange and clearance gap exists between these two flanges to enable the flexible flange to move away from the flanged end member when a thread is trapped. However, a disadvantage of this construction is that thread can enter the clearance gap, rather than entering the thread trapping groove. Since this gap is provided only for clearance, the loose end of the thread can easily escape and thereby cause unwinding of the thread from the spool.

In the preferred embodiment of the invention, the periphery of thread winding retaining flange is provided with saw teeth, any one of which serves to catch thread (as it is wound across the end of the spool) and to guide the thread into the thread retaining means. Preferably, each tooth has a first edge which is inclined at a relatively shallow angle and a second edge which is substantially vertical. The top of each tooth may be substantially flat, or it may follow the curvature of the periphery of the flange.

As mentioned above, production costs are increased by the need to produce conventional spools having a variety of different shapes and forms to accommodate threads and yarns of different lengths, thicknesses and types. As spools are mass-produced in millions, it is clearly most desirable to reduce the complexity and difficulties of manufacture as far as possible to reduce costs.

One way in which the latter problem may be overcome is to manufacture a spool as an assembly of component parts that may be individually selected to suit a predetermined length of thread to be wound on the spool and to provide a suitable thread trapping action. The above-mentioned EP-A-0073605 describes a spool which is an assembly of component parts including a sleeve, a thread trapping ring and flanged end members. Each of the flanged end members has a tubular extension which is received in the respective ends of the sleeve. However, these tubular extensions project only a short way into the sleeve and they must be secured to the sleeve by means of adhesive. The need to apply adhesive is disadvantageous in the course of manufacture. Moreover, a serious problem can arise if a gap is left between the end of the sleeve and the adjacent end flange. The thread can become trapped in such a gap during high speed winding. If this happens, the thread can break and/or the smooth guidance of the thread (i.e. in alternating directions along the length of the sleeve to provide a uniform thread winding) can be disrupted. In either case, the winding process will be interrupted until the fault is rectified.

It is also to be noted that in the spool described in EP-A-0073605, a gap could be left at either end of the sleeve, because the thread trapping ring is separate from the sleeve.

In accordance with a preferred embodiment of the invention, the latter problem is overcome by providing flanged end members which each have axially extending portions that are secured together internally of the sleeve when the component parts of the spool are assembled, the axially extending portions being secured together by a process which includes the steps of arranging for the ends of the axially extending portions to touch one another when the components of the spool are first assembled, and of urging the flanged end members towards one another whilst effecting a bonding process whereby any gap is taken up before the ends of the axially extending portions are bonded together.

Preferably, the bonding process is effected by means of welding, e.g. by means of ultrasonic welding apparatus, or by means of apparatus which produces a high frequency electrical and/or magnetic field. Such welding causes the ends of the tubular portions to soften, prior to bonding, so that when the flanged end members are urged together, any gap is taken up (which gap might otherwise exist between the end of the sleeve and a flanged end member). Preferably, the ends of the axially extending portions have a plurality of small protuberances, especially protuberances which are pointed, and the protuberances are arranged to touch one another so that they soften first, when the welding process is effected, to facilitate closure of the gap prior to bonding. When the components of the spool are first assembled, a gap exists between the end of the sleeve and one of the flanged end members (due to the extent of the axially extending portions), but this gap is eliminated when the material softens and the end members move towards one another during the bonding process. This technique advantageously provides a substantially perfect fit between the end of the sleeve and the flanged end member.

Preferably, the flanged end members are identical in shape thereby reducing the need to mould different parts. The thread winding retaining flange is also preferably integral with one end of the sleeve, since this avoids the problem of leaving any gap at one end of the spool. Sleeves having various diameters may be produced as separate components e.g. to accommodate thread of different thicknesses and lengths. This enables thread to be wound on a spool so that the outer layer of the wound thread has a substantially constant diameter thereby presenting a uniform appearance to customers.

As the sleeve may vary in diameter, there is the problem of centralising the sleeve on the axially extending portions of the flanged members. This problem is overcome in a preferred embodiment of the invention by providing a sleeve having ribs which extending radially inwardly to contact the outer surface of the axially extending portions of the flanged end members.

When the thread trapping means of the present invention is used in a spool which is an assembly of component parts, i.e. including a sleeve (preferably having an integral thread winding retaining flange), flanged end members and a dish-shaped resilient member (preferably in the form of a spoked wheel), particular advantages can be obtained. For example, sleeves with different outside diameters and/or of different lengths and/or of different shapes can easily be selected, as required, in order to vary the thread carrying capacity of the spool and/or the way in which the thread is drawn off. This selection can be made without the need to change the design of the resilient dish-shaped member or of the flanged end members. Hence the same thread trapping means can be used in a variety of different spools. This greatly simplifies the design and construction of spools and hence decreases the cost of their manufacture. Moreover, the dish-shaped resilient member is more versatile in providing effective thread trapping over a wider range of thread thicknesses. An additional advantage is that the components of the spool can be made of different materials and interchanged with one another to facilitate the choice of suitable materials for the component parts. For example, reprocessed materials can be used for parts not subjected to much stress, whereas high grade materials can be used for parts subjected to strong forces. Whilst the dish-shaped resilient member will provide safisfactory thread trapping for a wider range of thread thicknesses, the material from which it is made can be changed, e.g. to provide greater or lesser stiffness with regard to trapping thread of different thicknesses or types. This means that the same mould can be used to produce dish-shaped members having different resilient properties. However, once the dish-shaped resilient member has a relatively simple construction, a different mould could be readily made in order to change the properties, dimensions and/or shape of this part.

Suitably, the thread winding retaining flange is recessed to accommodate flexure of the dish-shaped resilient member and this flange has a central aperture which is bounded by a raised rim which engages the inner axial portion (hub) of the resilient member in order to press its outer peripheral portion (rim) firmly against the flanged end member when the components of the spool are assembled and secured together. The arrangement is such that the outer peripheral portion (rim) of the dish-shaped resilient member is pressed lightly against the flanged end member around its entire circumference, whilst the inner axial portion (hub) is pressed tightly against the flanged end member.

Preferred embodiments of the invention will now be described with reference to the accompany drawings in which:

FIG. 1 is a longitudinal section through two spools according to respective embodiments of the invention, one half of one spool being shown above a centre line y—y and one half of the other spool being shown below the centre line y—y, FIG. 2 is a longitudinal section through a flanged end member used in the type of spool shown in FIG. 1, FIG. 3 is an end elevation of the flanged end member shown in FIG. 2, FIG. 4 is an enlarged elevational view of part of the end of a tubular portion of the part shown in FIG. 2, FIG. 5 is a longitudinal section, on an enlarged scale, of part of the end of the tubular portion shown in FIGS. 2 and 4, FIG. 6 is a longitudinal section through a sleeve and thread winding retaining flange of a spool of the kind shown in FIG. 1 (lower half), FIG. 7 is an elevation of the part shown in FIG. 6, FIG. 8 is an end elevation, from the other end, of the part shown in FIG. 6, FIG. 9 is a section of a detail of FIG. 6, on an enlarged scale, FIG. 10 is a longitudinal section through a cup-spring, FIG. 11 is an end elevation of the cup-spring shown in FIG. 10, FIG. 12 shows a detail of FIG. 10 on an enlarged scale, FIG. 13 is a longitudinal section through a spool according to another embodiment of the invention and showing (below line y—y) a conical sleeve, FIG. 14 is a longitudinal section through a spool according to a further embodiment of the invention and showing (below line y—y) a diabolo-shaped sleeve, FIG. 15 is a section on line A/B of FIG. 14 of the lower section spool.

Figure 1:
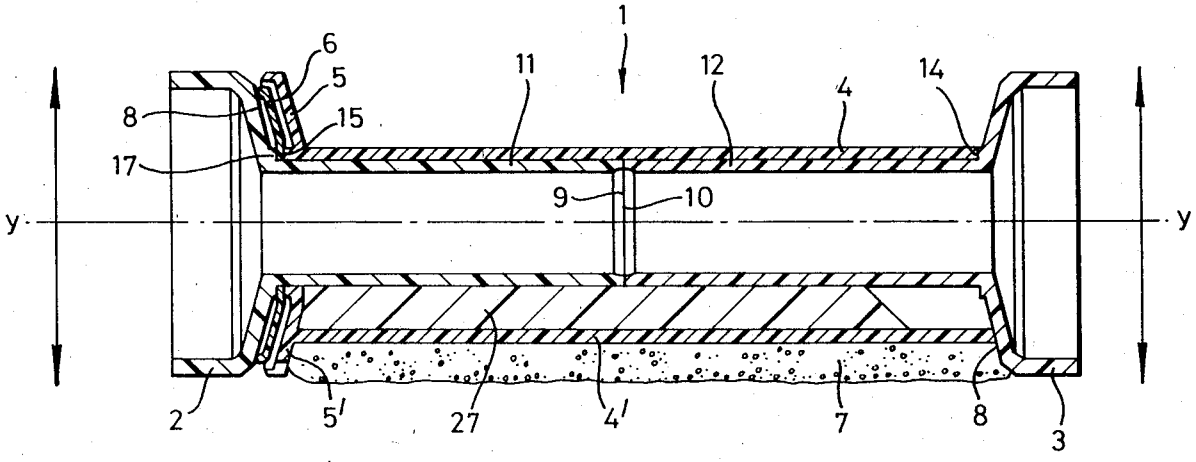
FIG. 1 is a longitudinal section through two spools according to respective embodiments of the invention and shown either side of a longitudinal axis or line y—y. The superimposition of these sections shows that the same kind of thread trapping means (as described below) can be used in each embodiment, despite the differences in the diameters of a sleeve (4) on which the thread (7) is wound.
Figure 10:
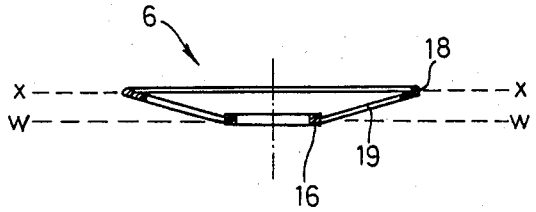
Figure 11:
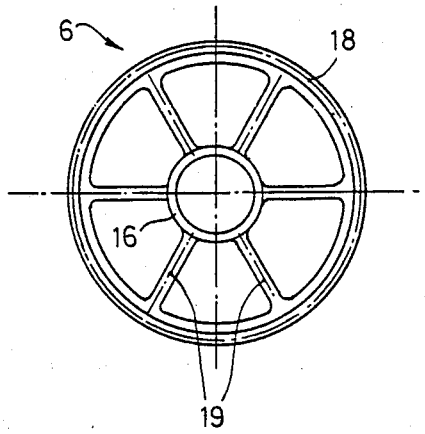

In each of the embodiments shown in FIG. 1, the spool is assembled from parts which include respective flanged end members 2,3 of identical construction; a sleeve 4 or 4' (the choice of sleeve depending on the length of thread to be wound on the sleeve), the sleeve having an integral thread winding retaining flange 5 or 5' at one end; and a resilient dish-shaped member or cup-spring 6. The cup-spring is shaped like a spoked wheel, as shown in FIGS. 10 and 11.

The sleeve 4 (4') has an outside diameter which determines the length of thread 7 to be wound on the spool. Sleeve 4' has a greater outer diameter than sleeve 4, whereby a greater length of thread (of the same thickness) can be wound on sleeve 4. Despite the difference in the outside diameters of the sleeves 4 and 4', since the cup-spring and the flanged end member 2 are independent of the sleeve 4 or 4', the same thread trapping means can be employed to secure a loose end of thread. Such thread trapping means is provided by the action of cup-spring 6 which bears against the conical face 8 of flanged end member 2, the thread being guided (as explained below) between the latter two component parts.

The thread-winding retaining flange 5 (5') retains the body of thread wound on the spool, since one end of this body of thread would otherwise interfere with the action of cup-spring 6. Flange 5 (5') is strong enough to resist any deformation which could occur due to the strong lateral forces which are exerted by the body of thread 7 at each end of the winding when the thread is wound onto the spool at high speed.

Figure 16:
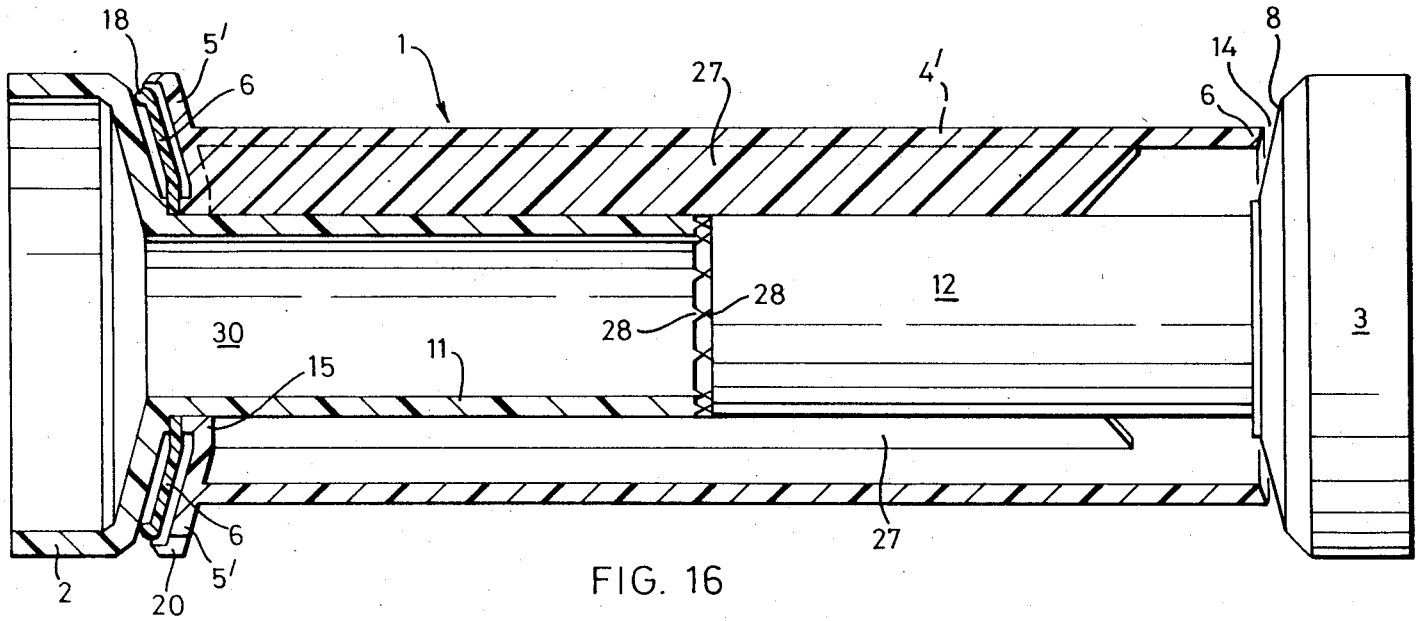
FIG. 16 illustrates the components of a spool, according to an embodiment like that shown in FIG. 1 (below line y—y), the components being shown assembled prior to welding.

The same flanged end members 2,3 can be advantageously used in either of the spools depicted in FIG. 1 so as to reduce the cost of manufacture of different spools to accommodate different lengths of thread. It will be noted, in FIG. 1, that the confronting ends 9,10 of axially extending core portions 11,12 of the respective flanged end members 2,3 are joined together centrally of the spool and internally of the sleeve 4 or 4'. These end portions 11,12 are welded together (as explained below). In FIG. 16, the welding process has not been completed and hence a gap 13 exists between the end of the sleeve 4 and the conical face of the flanged end member 3. This gap is closed during manufacture, as explained below.

Referring to FIG. 1, one end of sleeve 4 abuts a raised rim 14 on flanged end members 3, whilst the other end of sleeve 4 which is in the form of a raised rim 15 (in flange 5) presses a hub portion 16 of cup-spring 6 against a raised rim 17 on flanged end member 2. the same applies to sleeve 4' except that the right hand end of the sleeve presses directly against the conical face 8' of flanged end member 3.

Figure 17:
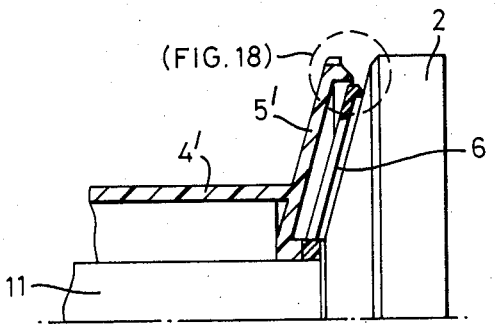
FIG. 17 is a view, partly in section, of parts which form the thread-trapping means of the spool.
Figure 18:
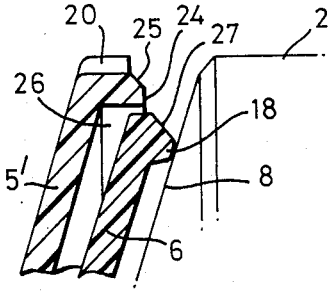
FIG. 18 is a section, on an enlarged scale through the thread trapping means of FIG. 17.

Referring to FIGS. 10 and 11, the cup-spring 6 is in the shape of a wheel having a hub portion 16 joined to a circular rim portion 18 by spokes 19. The cup-spring 6 is frusto-conical in shape, as shown by FIG. 10. Referring to FIGS. 16, 17 and 18, the rim 18 extends continuously and circularly adjacent the corresponding frusto-conical face 8 of the flanged end member 2. The thread winding retaining flange 5 or 5' (FIG. 6) has a corresponding frusto-conical shape and it has a recess 20 to accommodate flexure of the cup-spring 6. The raised rim 15 on the flange 5 (5') presses against the hub portion 16 of the cup-spring 6 and at the same time spaces the cup-spring 6 away from the flange 5 (5') to enable the cup-spring 6 to deflect when a loose end of thread is pulled between the rim 18 and the conical face 8. Whilst flanges 5 and 5' are shown as being integral with the respective sleeve 4 and 4', the flanges 5 and 5' could be made as separate parts. Whilst the raised rim 15 presses hard against the hub portion 16 to secure the cup-spring 6 firmly to the spool, the outer peripheral rim 18 is urged lightly against the conical face 8. This is due to the spacing between the planes x—x and w—w in which the rim 21 and the hub portion 16 are located. In other words, when the cup-spring 6 is initially fitted onto the axially extending portion 11 of the flanged end member 2, the rim 18 initially contacts the conical face 8 and a slight gap is present between the hub 16 and the raised rim 17 on the flanged end portion 2. This gap is closed when the flanged end portions 2,3 are urged towards one another during the welding process (described below). As the gap closes, the rim 18 is urged lightly against conical face 9 because the spokes 19 yield slightly and apply a gentle axial force on the rim 21. Thus, a uniform pressure is applied around the entire rim 18 thereby ensuring a substantially uniform or positive grip on thread which is secured, at any point, around the circumference of the rim. This positive grip can be applied to threads of different thicknesses in view of the way in which the spokes deflect when the thread is trapped.

Besides bracing the rim 21 against the core of the spool, the spokes 19 economize on the material from which the cup-spring 6 is made.

As the cup-spring 6 is separate from the flanged end portion 2 and the sleeve 4, 4' with its integral flange 5, (5') this simple part alone can be designed, produced and exchanged in a simple manner to provide a thread trapping action to suit the particular type and/or thickness of thread or yarn which is wound onto the sleeve. However, in the case of known spools, where the thread trapping means is integral with the spool, the whole spool needs to be structurally redesigned to modify the thread trapping action.

Figure 8:
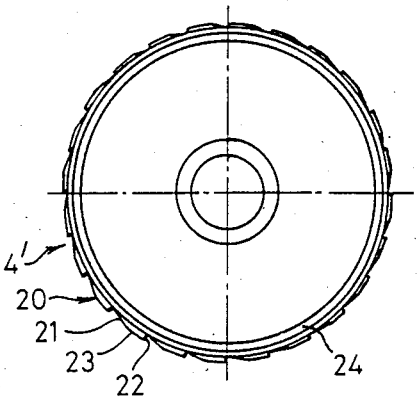
Figure 7:
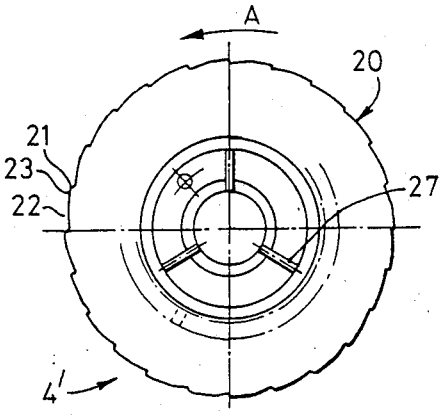
Figure 9:
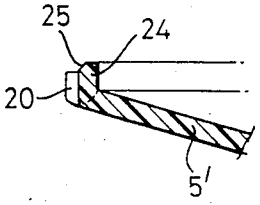

As shown in FIGS. 7 and 8, the outer periphery of the thread-winding retaining flange 5' (and 5) is provided with a plurality of saw teeth 20. Each tooth 20 has an inclined side 21 (which is inclined at a relatively shallow angle from the horizontal), a steep and substantially vertical side 22 and a top 23 which is substantially parallel with a circular raised bead 24. Thread which is introduced, in the winding direction shown by arrow A (FIG. 7) is caught directly by the steep side 21 of one of the teeth 20 and is thereby introduced into the thread trapping means.

Figure 6:
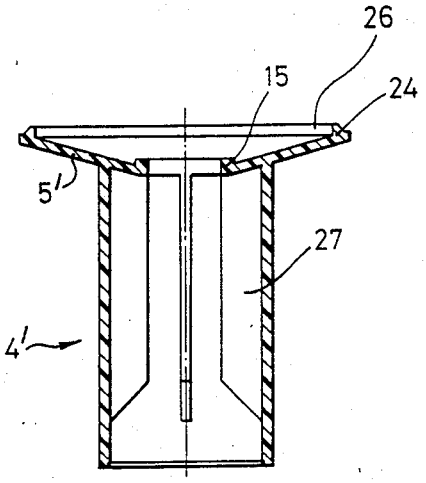
Figure 12:
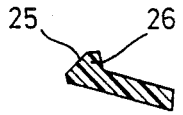

As shown in FIGS. 6 and 8, the circular bead 4 has a chamfer 25. Likewise, the rim 18 of the cup-spring 6 has a raised bead 26 (FIG. 12) with a chamfer 27. As shown in FIGS. 17 and 18, both rim 8 of the cup-spring 6 and rim 24 of flange 5' project in an axial direction away from sleeve 4'. Moreover, rim 18 projects beyond rim 24 so that thread, drawn between adjacent teeth 20, is guided first onto chamfer 24 before cascading down onto chamfer 27 where it is guided directly between the rim 18 and the conical face 8 of the flanged end portion 2. The way in which the chamfers 25 and 27 cooperate substantially eliminates the possibility of thread entering the clearance space defined by recess 26 in flange 5'.

Thus, the teeth and the chamfered rims 18 and 4 cooperate to guide thread positively into the thread trapping means without the risk of thread being misguided, e.g. into other grooves as in the case of certain known spools. Moreover, in the case of overhead unwinding of the thread from the spool, the relatively shallow inclined sides 22 of teeth 20 ensure that thread is pulled off without catching any parts of the end of the spool thereby avoiding any jerking of the spool during sewing. With some conventional spools, thread can sometimes catch in the end of the spool and cause jerking or even cause the spool to be pulled from a spindle on which it is supported on a sewing machine.

Whilst the drawings illustrate flanges 5, 5' provided with teeth 20, these teeth could be alternatively provided on the outer periphery of the rim 18 of a suitably designed cup spring 6.

Referring to FIGS. 1, 6 and 16, the sleeve 5' is provided with internal ribs 27 which project radially inwardly by the same extent and which are arranged at equidistant angular positions around the inner circumference of the sleeve 4'. In the preferred embodiment these ribs are spaced 120° apart. The ribs 27 serve to locate and to centralize the axially extending core portions 11,12 of the flanged end members 2,3. The outside diameter of sleeve 4' can be varied by changing the radial extent of ribs 27. This enables the thread carrying capacity of the sleeve 4' to be varied whilst retaining the use of the same flanged end members 2, 3 and cup-spring 6, e.g. as depicted in FIG. 1.

Referring to FIGS. 4, 5 and 16, the ends 9,10 of the axially extending portions 11,12 are each provided with a series of spaced, pointed protuberances 28. The points of the protuberances on portion 11 correspond with and touch the points of the protuberances on portion 12 when portions 11 and 12 are received within the sleeve 4' (as shown in FIG. 16). The points can be brought into alignment by causing relative rotation between the flanged end members 2,3 until an indexing projection 29 (FIGS. 2 and 3) on the side of each flange is brought to a predetermined angular position.

As shown in FIG. 16, the component parts of the spool have been assembled prior to the welding process. In assembling these components, the cup spring 6 and the sleeve 4' are slid onto the axially extending portion 11 of the flanged end member 2. The axially extending portion 12 of the flanged end member 3 is then introduced into the sleeve 4'. The axially extending portions 11,12 are automatically centered by the ribs 27. The protuberances 28 on portions 11,12 are aligned, e.g. by causing relative rotation between the flanged end members 2,3. The flanged end members 2,3 are then urged together, e.g. by pressing one one of these members whilst the other is held firmly, so that the pointed protuberances 28 make firm contact with one another before the welding process is started. Energy is then introduced e.g. by inserting an ultrasonic welding head into passage 30 which extends through the spool 1 (which passage is provided to receive a spindle on a sewing machine and which has an internal diameter to prevent the spool from wobbling on the spindle). The points of the protuberances 28 have the effect of intensifying the welding process when the energy is applied. Moreover, as these points soften the ends 9,10 move closer together and this has the effect of closing gap 14 between one end 6 of sleeve 4' and the conical face 8' of the flanged end member 3. Eventually, the end 6 of sleeve 4' makes contact with the conical face 8' and the ends 9,10 are bonded together when the welding process is discontinued. This welding technique ensures a substantially perfect fit between the end 6 of the sleeve 4' and the conical face 8'. Moreover, the technique enables a spool to be quickly and cheaply produced which has the required shape (e.g. to accommodate a predetermined length of thread) and the required component parts (e.g. made of different materials) to ensure perfect running.

Whilst the outside diameter of sleeve 4' may be varied to change the thread carrying capacity of the spool, it is also possible to extend or to shorten the axially extending portions 11,12 to lengthen, or shorten the spool for the same purpose. The length of the sleeve 4' would be correspondingly lengthened or shortened, but the same cup-spring could still be used. The changes which would be required to lengthen or shorten the spool can be readily affected and hence this avoids the problem of increased expense with regard to changing a complete and possibly complex moulding with certain conventional spools.

Thus, the shapes of the component parts of the spool embodying the invention facilitate changes in design, shape or form thereby providing grater versatility without significantly increasing the cost of manufacture.

Figure 13:
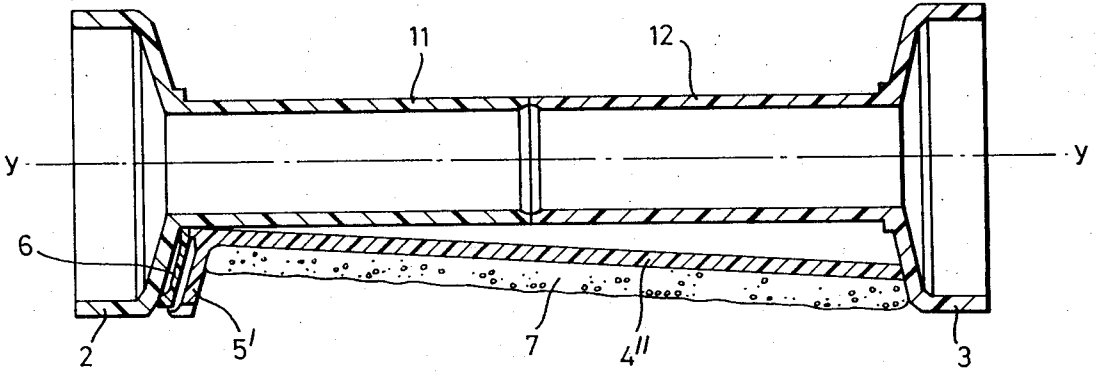

FIG. 13 illustrates another embodiment of the invention where the sleeve 4'' has a conical shape, the smallest diameter being located adjacent flange 5' next to the cup-spring 6. The conical sleeve 4'' is selected when thread is required to be drawn off rather than at right angles to the central axis y—y of the spool.

Figure 14:
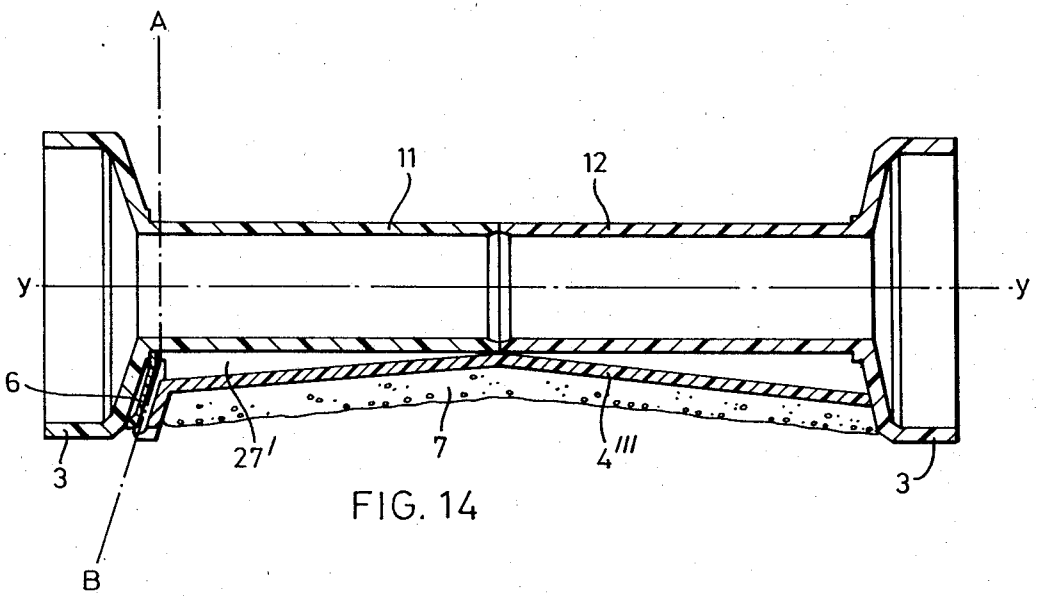
Figure 15:
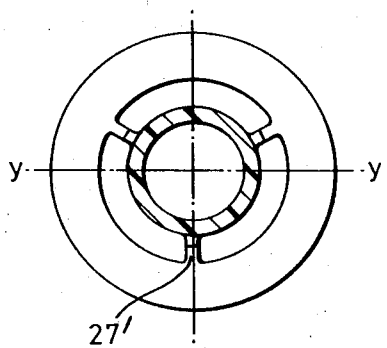

A further embodiment is shown in FIGS. 14 and 15 where the sleeve 4''' is of a diabolo shape. The smallest diameter of the sleeve is located centrally between the flanged end members 2,3. Sleeve 4''' is also selected when thread is required to be drawn off in a specific direction. As shown in FIG. 15, the sleeve 4''' is mounted on the axially extending portions 11,12 by means of centralizing ribs 27.

In both FIGS. 13 and 14, the shape of the sleeves 4'', 4''' have been shown on only one side of the axis y—y and it will be understood that each of these sleeves is symmetrical about the latter axis.

Instead of using ribs 27, other means for distancing the sleeve 4' from the axially extending portions 11,12 may be used. For example, distance rings may be located concentrically with axially extending portions 11,12 and such distance rings or spacers may be fitted either separately or they may be integral with the portions 11,12.

I claim:

1. A spool comprising a sleeve, flanged end members at respective ends of the sleeve, a thread-winding retaining flange adjacent one of the flanged end members, and a circular member positioned adjacent one of the flanged members to provide means for trapping a loose end of yarn, thread of the like wound on the sleeve, the circular member being resilient and dish-shaped and being positioned between the thread-winding retaining flange and said one flanged end member, said dish-shaped circular member having an inner axial portion, an outer peripheral portion and at least one intermediate portion joining the inner and outer portions, the inner and outer portions being located in different planes.

2. A spool according to claim 1, wherein said dish-shaped circular member is a cup-spring in the form of a spoked wheel, said outer and inner portions corresponding respectively with the rim and the hub of the wheel, and said intermediate portions corresponding with the spokes of the wheel.

3. A spool according to claim 2, wherein said dish-shaped member is frusto-conical in shape.

4. A spool according to claim 3, wherein the thread-winding retaining flange and the adjacent flanged end member are conically shaped to correspond with the shape of said dish-shaped member.

5. A spool according to claim 1, wherein the thread-winding retaining flange is recessed to accommodate flexure of said dish-shaped member.

6. A spool according to claim 5, wherein the thread-winding retaining flange is integral with the sleeve.

7. A spool according to claim 1, wherein the periphery of the thread-winding retaining flange is provided with teeth, each tooth having a steep side in the direction of winding of the thread on the spool.

8. A spool according to claim 1 wherein the peripheries of the thread-winding retaining flange and of the dish-shaped member each have chamfered rims, the chamfered rim of the dish-shaped member being situated below, and projecting beyond the chamfered rim of the thread-winding retaining flange.

9. A spool according to claim 1, wherein the flanged end members each having axially extending portions which are bonded together by a process which includes the steps of arranging for the ends of the axially extending portions to touch one another when the components of the spool are first assembled and urging the flanged end members towards one another while effecting bonding, any gap adjacent the en of the sleeve being thereby taken up before the axially extending portions are bonded together.

10. A spool according to claim 9, wherein the bonding process is achieved by welding, the ends of the axially extending portions having protuberances which facilitate said welding.

11. A spool according to claim 9 wherein the flanged end members are identical in construction.

12. A spool according to claim 9, wherein the sleeve is provided with ribs which extend radially inwardly for centralising and locating the axially extending portions of the flanged end members relative to the sleeve.

13. A spool according to claim 9, wherein one end of the sleeve has a raised rim which presses axially against the dish-shaped member whilst enabling the periphery of the dish-shaped member to be lightly biased towards said adjacent flanged end members.

14. A spool according to claim 9, wherein the sleeve is one of a set having different outside diameters, or lengths, or shapes.

15. A spool according to claim 14, wherein the sleeve has a conical shape.

16. A spool according to claim 14, wherein the sleeve has a concave surface.

17. A method of producing a spool of yarn, thread or the like, wherein the spool includes separate component parts including a sleeve flanged end members for respective ends of the sleeve, and a circular member to be positioned adjacent one of the flanged members to provide thread trapping means, the method including:

(a) providing a thread winding retaining flange which is preferably integral with the sleeve, (b) providing a circular member which is resilient and dish-shaped, (c) providing the flanged end members with axially extending portions having ends which touch internally of the sleeve when the component parts are assembled, (d) assembling the dish-shaped, resilient member and the sleeve on the axially extending portion of said adjacent flanged end member, (e) inserting the axially extending portion of the other flanged end member into the sleeve so that the ends of the axially extending portions touch one another, and (f) urging the flanged end members towards one another whilst effecting a bonding process in order to close any gap at the end of the sleeve before the axially extending portions are bonded together.

* * * * *